US005839381A

United States Patent [19]

Woelfle

[11] Patent Number: 5,839,381

[45] Date of Patent: Nov. 24, 1998

[54] EMBROIDERING MACHINE HAVING FIRST-ORDER MASS COMPENSATION

[75] Inventor: Paul Woelfle, Krefeld, Germany

[73] Assignee: S & W Engineering GmbH, Moers, Germany

[21] Appl. No.: 874,648

[22] Filed: Jun. 13, 1997

[30] Foreign Application Priority Data

Jun. 13, 1996 [DE] Germany ..... 196 23 530.8

[51] Int. Cl.[6] ..... D05B 69/32

[52] U.S. Cl. ..... 112/221; 112/98; 74/603

[58] Field of Search ..... 112/220, 221, 112/80.04, 78, 80.4, 80.45, 98, 283, 284, 259, 117, 470.18, 470.12; 74/603, 604, 47, 413

[56] References Cited

U.S. PATENT DOCUMENTS

| | | | |
|---|---|---|---|
| 1,704,009 | 3/1929 | Lehmann | 112/117 X |
| 2,128,120 | 8/1938 | Christensen et al. . | |
| 2,889,972 | 6/1959 | Scheibel | 112/98 |
| 3,749,037 | 7/1973 | Cash | 112/117 |
| 4,632,072 | 12/1986 | Brogdon | 74/603 X |
| 4,669,403 | 6/1987 | Bagnall | 112/80.4 |
| 4,966,042 | 10/1990 | Brown | 74/604 X |
| 5,287,819 | 2/1994 | Beatty et al. | 112/221 X |
| 5,572,939 | 11/1996 | Beatty | 112/221 X |

FOREIGN PATENT DOCUMENTS

| | | |
|---|---|---|
| 3341444 | 3/1985 | Germany . |
| 3923419 | 1/1990 | Germany . |

*Primary Examiner*—Ismael Izaguirre
*Attorney, Agent, or Firm*—Robert W. Becker & Associates

[57] ABSTRACT

An embroidering machine having a plurality of embroidering heads attached to a longitudinally extending carrier and each having a needle drive mechanism for an embroidering needle that is moveable in a vertical plane in the respective embroidering head. Each needle drive is connected to a driven main shaft that is guide through the embroidering machine parallel to the longitudinally extending carriers. For complete mass compensation, each drive arrangement of the embroidering head comprises an externally toothed gear wheel disposed on the driven main shaft and a second externally toothed gear wheel disposed on a compensating shaft oriented parallel to the main shaft. The gear wheels, the external teeth of which mesh with one another, are each provided with a compensating mass in order to completely compensate for the oscillations caused by the longitudinal movement of the needle bar, which is effected in the vertical plane, with the oscillations occurring in the horizontal direction transverse to the main shaft.

5 Claims, 3 Drawing Sheets

EMBROIDERING MACHINE HAVING FIRST-ORDER MASS COMPENSATION

BACKGROUND OF THE INVENTION

The present invention relates to an embroidering machine having a plurality of embroidering heads attached to a longitudinally extending carrier and each being provided with a needle drive mechanism for an embroidering needle that is movable in a vertical plane in the respective embroidering head. Each of the needle drive mechanisms is connected to a driven main shaft that is guided through the embroidering machine parallel to the longitudinally extending carrier. Each needle drive mechanism comprises a drive arrangement that bridges the horizontal spacing between the embroidering needle and the main shaft, the drive arrangement being provided with an eccentrically disposed connecting rod for converting the rotational movement of the main shaft into the longitudinal movement of a needle bar that carries the embroidering needle.

An embroidering machine having the aforementioned features is known from DE 39 23 419. The design of this known embroidering machine is characterized in that the gripper shaft, which drives the gripper that is associated with the embroidering needle, i.e. the associated needle bar, is disposed transverse to the longitudinally extending main shaft, thus necessitating that the needle bar be laterally offset relative to the main shaft. This known arrangement has the drawback that the oscillating masses of the needle drive mechanism are not completely compensated for. The mass of the upwardly and downwardly moving needle bar requires a mass equalization or compensation in the region of the rotary drive mechanism that drives the needle bar. The consequence of this mass compensation that is realized at the rotary drive mechanism is that when the rotary drive mechanism rotates, mass or inertial forces also act transversely to the plane of the needle movement and, hence, transversely to the direction of the orientation of the carrier through the embroidering machine. In embroidering machines having several embroidering heads disposed next to one another in the longitudinal axis of the embroidering machine, this effect is intensified since the carrier is caused to oscillate due to the oscillations that act upon the carrier, so that the distance between the needle carried by the needle bar and the gripper does not remain constant, as a result of which threads are caused to break.

It is therefore an object of the present invention to avoid these drawbacks in an embroidering machine of the aforementioned construction, and to insure a constant distance between the needle and the associated gripper during operation of the embroidering machine.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
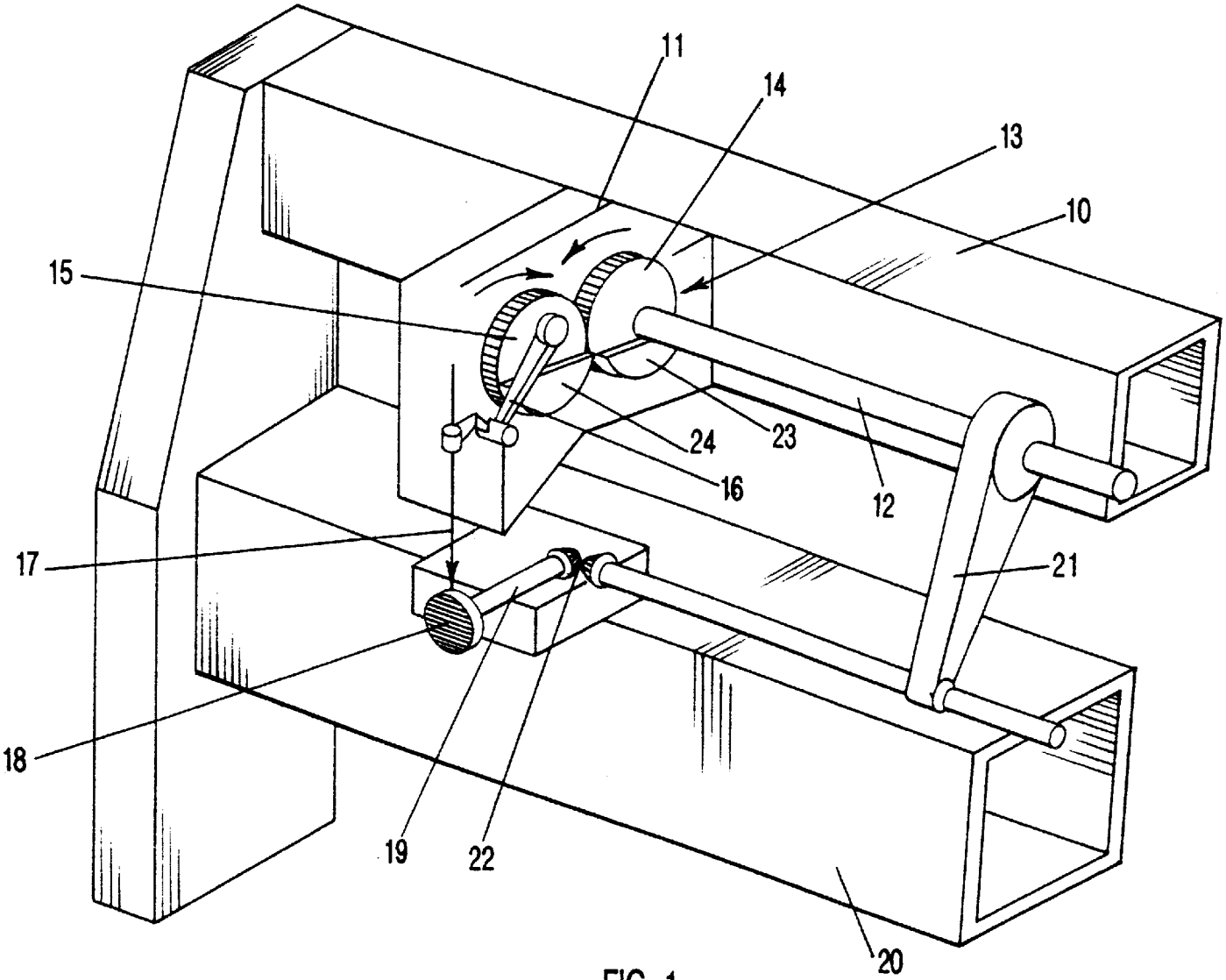
FIG. 1 shows a portion of one exemplary embodiment of the inventive embroidering machine with an embroidering head.

The basic concept of the embroidering machine of the present invention is that the drive arrangement of the embroidering head respectively comprises an externally toothed gear wheel disposed on the driven main shaft, as well as a second externally toothed gear wheel disposed on a compensating shaft that is oriented parallel to the main shaft; the external teeth of the gear wheels mesh with one another, and the gear wheels are each provided with a compensating mass in order to completely equalize or compensate for oscillations caused by the longitudinal movement of the needle bar as effected in the vertical plane, which oscillations occur in the horizontal direction transverse to the main shaft.

Since the needle drive mechanism is realized by the gear pair comprising two oppositely rotating gear wheels, each of which is provided with a compensating mass, the free inertial forces that occur transverse to the axis of the main shaft, i.e. transverse to the carrier, are compensated for so that due to this first-order mass compensation achieved with the present invention, no horizontally oriented oscillations that are caused by transverse forces occur; the distance between the embroidering needle and the associated gripper also remains unchanged in every operating state of the embroidering machine.

To the extent that in a sewing machine drive mechanism known from DE 33 41 444 C2 provision is already made for a compensation of the inertial forces caused by a slider-crank drive mechanism used in such a machine, an elaborate mechanism having a plurality of shafts and gear wheels is provided for that purpose. Since in the case of the aforementioned embroidering machine having a number of embroidering heads such a mechanism would have to be provided for each individual embroidering head, this solution involves a correspondingly high degree of complexity if utilized on the aforementioned type of embroidering machine having a plurality of embroidering heads. Furthermore, due to the overall axial structural width that is required to accommodate the compensating mechanism, the distance between the embroidering needle and the main shaft, which is of course absent in the case of a single sewing machine, would have to be relatively large, as a result of which the overall size of each individual embroidering head would also have to be increased.

Pursuant to one specific embodiment of the present invention, the compensating shaft, with the second externally toothed gear wheel disposed thereon for bridging the horizontal distance between the needle bar and the main shaft, is disposed between the needle bar and the main shaft, and the connecting rod for the needle bar is attached to the second gear wheel eccentrically relative to the axis of the compensating shaft.

Such a design advantageously realizes a so-called slider-crank drive mechanism for the embroidering needle, i.e. for the needle bar, similar to the construction in DE 33 41 444 C2, but without the need for a greater distance between the needle bar and the main shaft. The distance defined by the gripper shaft, which extends transverse to the main shaft, is utilized as part of the needle drive mechanism by the provision of the second externally toothed gear wheel, which is provided with a compensating mass; in so doing, it is possible to dispense with an additional crankshaft that extends transverse to the main shaft.

As an alternative to the connecting rod disposed eccentrically relative to the axis of the compensating shaft in the manner of a slider-crank drive mechanism, it also possible to dispose the connecting rod on the compensating shaft as an eccentric drive mechanism and to connect it to the needle bar by means of a draw lever and a drive connecting rod.

Pursuant to another specific embodiment of the present invention, the connecting rod can be connected directly to the first externally toothed gear wheel, which is mounted on the main shaft, with the connecting rod being coupled as an eccentric drive mechanism to the needle bar by means of a draw lever and a drive connecting rod; The compensating shaft, with the second externally toothed gear wheel disposed thereon, is associated with the main shaft beyond the eccentric drive mechanism. With this arrangement, it is possible for the actual needle drive mechanism to also be coupled directly to the first externally toothed gear wheel, which is carried and driven by the main shaft, whereby the additional second externally toothed gear wheel, which is disposed on the compensating shaft, which is oriented axially parallel to the main shaft, and which rotates in a direction opposite to that of the main shaft, merely serves for mass compensation due to the compensating mass disposed thereon. In this case, the eccentric drive mechanism is realized in that the connecting rod, which is coupled to the needle bar by means of a draw lever and a drive connecting rod, is eccentrically attached to the gear wheel.

Pursuant to another specific embodiment of the present invention, the gear wheels with the compensating masses can be disposed outside the embroidering head.

Further specific embodiments of the present invention will be described in detail subsequently.

DESCRIPTION OF PREFERRED EMBODIMENTS

Referring now to the drawings in detail, FIG. 1 shows a machine frame 20 to which is attached a longitudinally extending carrier 10. In the illustrated embodiment, an embroidering head 11 is attached to the carrier 10; although not illustrated, for larger embroidering machines several such embroidering heads 11 are attached to the carrier 10. Extending parallel to the carrier 10 in the longitudinal direction of the machine is a main shaft 12 that drives a needle drive mechanism 13 that is associated with the embroidering head 11. For this purpose, disposed on the main shaft 12 is a first externally toothed gear wheel 14 with which a second externally toothed gear 15 is associated in such a way that the outer teeth of the gear wheels 14, 15 mesh with one another. As a consequence, a rotation of the drive shaft 12 with the first gear wheel 14 is necessarily converted into a counter-rotating movement of the second gear wheel 15, as indicated by the arrows in FIG. 1.

Eccentrically attached to the second gear wheel 15, in the manner of a slider-crank drive mechanism, is a connecting rod 16, the free end of which is connected to a needle bar 17 so that the rotational movement of the second gear wheel 15 is, via the connecting rod 16, converted into a longitudinally directed movement of the needle bar 17.

To drive a gripper 18 that is associated with the needle carried by the needle bar 17, a gripper shaft 19 is mounted on the machine frame 20; this gripper shaft extends transverse to the longitudinal axis of the carrier 10, and hence to the main shaft 12. The gripper shaft 19 is coupled to the drive shaft 12 by means of a bevel gear mechanism 22 and a positive transmission element 21. In the illustrated embodiment, the distance between the needle bar 17 and the main shaft 12 is utilized as a component part of the drive arrangement for the needle bar 17 via the insertion of the second gear wheel 15.

In order to compensate for the oscillations that are caused by the longitudinal movements of the needle bar 17 and are effected in the vertical plane, which oscillations furthermore act in the horizontal direction upon the carrier 10 transversely relative to the main shaft 12, the first gear wheel 14 is provided with a compensating mass 23 and the second gear wheel 15 is provided with a compensating mass 24. The compensating masses 23, 24 are each disposed in a symmetrical arrangement on the gear wheels 14, 15 on the same side of the drive shaft. Consequently, due to the counter rotation of the gear wheels 14, 15, during each complete rotation of the gear wheels 14, 15 the compensating masses 23, 24 pass each other one time.

Figure 2:
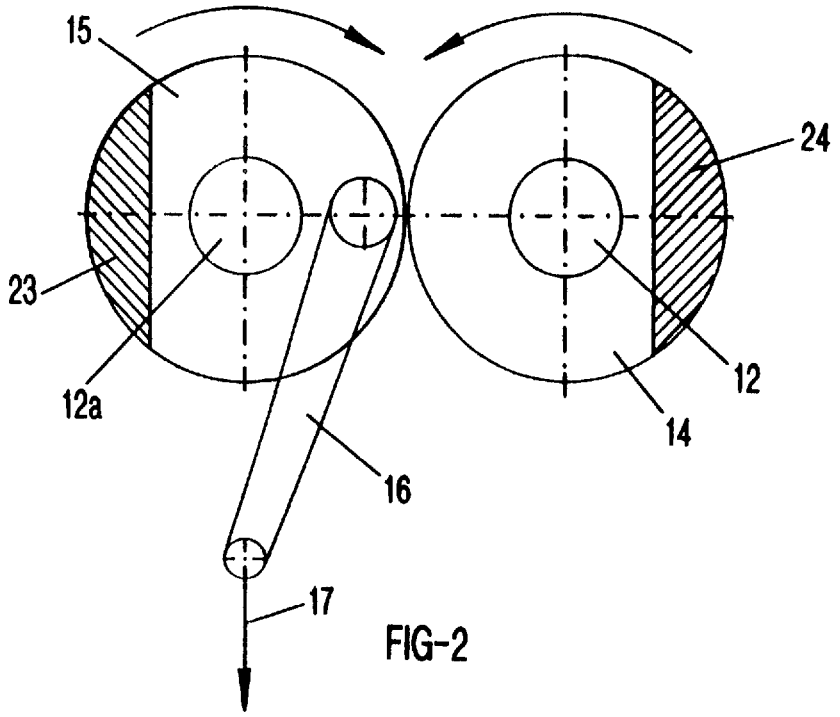
FIG. 2 illustrates the needle drive mechanism, with mass compensation, for the embroidering machine of FIG. 1.

FIG. 2 illustrates the gear wheels 14, 15 in a manner corresponding to the needle drive mechanism 13 shown in FIG. 1. Due to the compensating masses 23, 24 disposed on the two gear wheels 14, 15, there is provided a full compensation of the masses of connecting rod 16, needle bar 17, and needle as a vertically moved mass, without horizontal oscillations occurring. Starting from the position illustrated in FIG. 2, if the gear wheels 14, 15 rotate in the direction of the arrows, the vertically moved masses undergo a downward acceleration that is compensated by the sum of the two compensating masses 23, 24 that in the lowest position of the needle bar 17 are disposed on the gear wheels 14, 15 on the upper vertex of the circular path. Consequently, no horizontal forces occur since the compensating masses 23, 24 respectively effect mutual compensation during their rotation beyond the plane of movement of the vertically moved masses.

Figure 4:
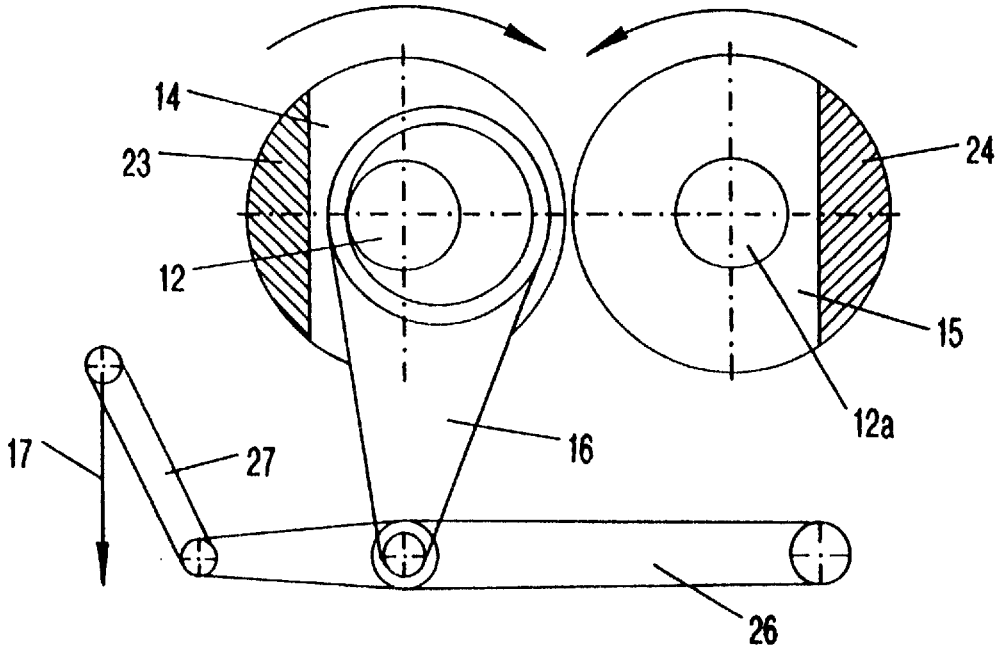
FIG. 4 shows a modified design of the arrangement of FIG. 2.

FIG. 4 illustrates an alternative embodiment of the needle drive mechanism 13, according to which the first externally toothed gear wheel 14, which is carried by the main shaft 12, is now directly coupled with the eccentric drive mechanism for the needle bar 17. In particular, this eccentric drive mechanism comprises the driver 16, which is eccentrically attached to the first gear wheel 14 and is coupled to the needle bar 17 by means of a draw lever 26 and a drive connecting rod 27. In this specific embodiment, in order to compensate for the oscillations caused by the longitudinal movements of the needle bar 17 and effective in the vertical plane, which oscillations act upon the carrier 10 in a horizontal direction transverse to the main shaft 12, the second externally toothed gear wheel 15, with the compensating mass 24 disposed thereon, is disposed beyond the actual needle drive mechanism 13 on a compensating shaft 12*a* that is oriented parallel to the main shaft 12, and to this extent serves merely for the first-order mass compensation or equilibrium.

Figure 3:
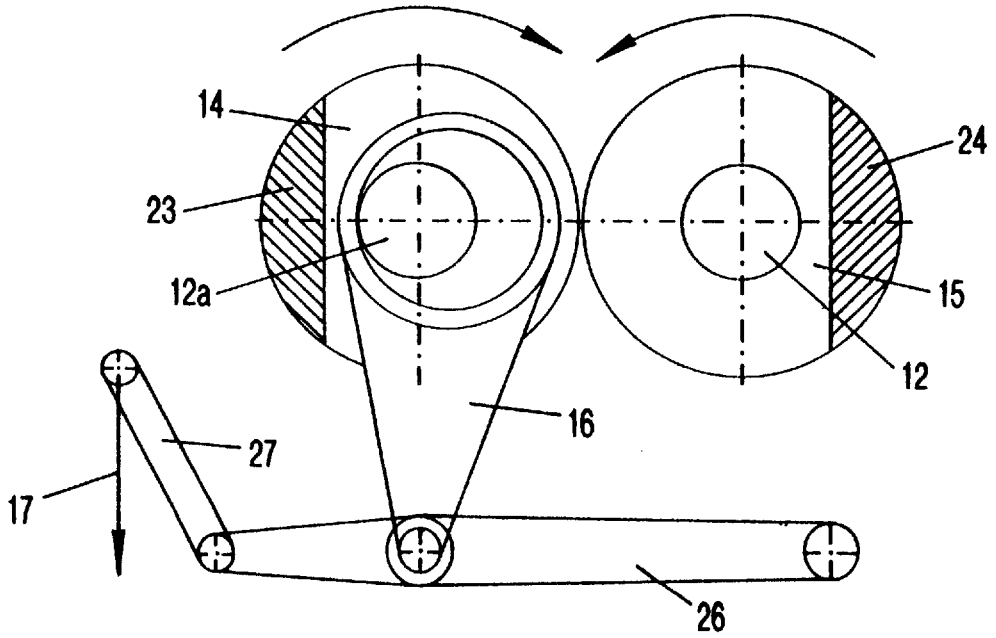
FIG. 3 is a view similar to FIG. 2 but showing an eccentric drive mechanism according to FIG. 4.

FIG. 3, with reference to FIG. 2, illustrates an embodiment of the needle drive mechanism where the eccentric drive mechanism in FIG. 4 is realized by the drive arrangement of FIG. 2, where the connecting rod 16 is disposed as an eccentric drive mechanism on the compensating shaft 12*a*, so that the mass forces resulting with a drive according to FIG. 4 are the same as those described in relation to FIG. 2

The present invention is, of course, in no way restricted to the specific disclosure of the specifications and drawings, but also encompasses any modifications within the scope of the appended claims.

What I claim is:

1. In an embroidering machine having a plurality of embroidering heads attached to a longitudinally extending carrier, each of said embroidering heads being provided with a needle drive mechanism for an embroidering needle that is movable in a vertical plane in said embroidering head, said needle drive mechanism being connected to a driven main shaft that is guided through said machine parallel to said longitudinally extending carrier, said needle drive mechanism comprising a drive arrangement that bridges a horizontal distance between said embroidering needle and said main shaft and includes an eccentrically disposed connecting rod means for converting rotational movement of said main shaft into longitudinal movement of a needle bar that carries said embroidering needle, the improvement wherein:

said drive arrangement of said needle drive mechanism of said embroidering head comprises a first externally toothed gear wheel disposed on said driven main shaft and a second externally toothed gear wheel disposed on a compensating shaft that extends parallel to said main shaft, whereby said connecting rod means is eccentrically connected to one of said first and second gear wheels, wherein said teeth of said gear wheels mesh with one another, and each of said gear wheels is provided with a respective compensating mass to compensate for oscillations caused by said longitudinal movement of said needle bar in a vertical plane, said oscillations occurring in a horizontal direction transverse to said main shaft.

2. An embroidering machine according to claim 1, wherein said compensating shaft, with said second externally toothed gear wheel disposed thereon for bridging said horizontal distance between said needle bar and said main shaft, is disposed between said needle bar and said main shaft, and said connecting rod means for said needle bar is connected to said second gear wheel eccentrically relative to an axis of said compensating shaft.

3. An embroidering machine according to claim 2, wherein said connecting rod means is disposed as an eccentric drive mechanism on said compensating shaft and is coupled to said needle bar by means of a draw lever and a drive connecting rod.

4. An embroidering machine according to claim 1, wherein said connecting rod means is connected directly to said first externally toothed gear wheel of said main shaft and as an eccentric drive-mechanism is coupled to said needle bar by means of a draw lever and a drive connecting rod, and wherein said compensating shaft, with said second externally toothed gear wheel disposed thereon, is disposed beyond said eccentric drive mechanism of said main shaft.

5. An embroidering machine according to claim 1, wherein said first and second gear wheels, with their associated compensating masses, are disposed outside said embroidering head.

* * * * *